US005436415A

United States Patent [19]

Smith et al.

[11] Patent Number: 5,436,415

[45] Date of Patent: Jul. 25, 1995

[54] INTERLOCK FOR ELECTRICAL SWITCHES

[75] Inventors: George A. Smith, North Huntingdon; Thomas K. Fogle, Pittsburgh, both of Pa.; Mark L. Lotzmann, London, Ky.

[73] Assignee: Eaton Corporation, Cleveland, Ohio

[21] Appl. No.: 277,059

[22] Filed: Jul. 19, 1994

[51] Int. Cl.[6] ..... H01H 9/26

[52] U.S. Cl. ..... 200/50 C

[58] Field of Search ..... 200/5 R-5 EB, 200/50 C, 17 R, 18; 335/160; H01H 9/26

[56] References Cited

U.S. PATENT DOCUMENTS

| | | | |
|---|---|---|---|
| 3,401,364 | 9/1968 | Whiting | 335/160 |
| 3,736,538 | 5/1973 | Owen | 335/160 |
| 3,767,872 | 10/1973 | Whitchurch | 200/50 C |
| 3,778,633 | 12/1973 | DeVisser et al. | 200/50 C X |
| 4,103,133 | 7/1978 | Erickson et al. | 200/18 |
| 4,286,242 | 8/1981 | Mrenna et al. | 335/160 |
| 4,295,053 | 10/1981 | Kovatch et al. | 200/50 C X |
| 4,398,097 | 8/1983 | Schell et al. | 307/64 |
| 5,081,367 | 1/1992 | Smith et al. | 307/64 |
| 5,272,291 | 12/1993 | Erickson | 200/18 |

*Primary Examiner*—J. R. Scott
*Attorney, Agent, or Firm*—Martin J. Moran

[57] ABSTRACT

An interlock for a pair of electrical switching devices includes plungers mounted through the switch housing and engaging the operating mechanism which opens and closes the switch. The plunger of each switch is coupled to a pivotally mounted cam plate by a pin which engages a camming slot in the cam plate for mutual movement of the plunger and cam plate. The cam plates associated with the pair of switches are connected by a connecting link for coordinated rotation. When one switch is closed, the operating mechanism extends the associated plunger which through the cam plates and connecting link raises the other plunger to block closing of the other switch. When a plunger is in blocking position, the coupling pin engages an overtoggle section of the camming slot of the associated cam plate such that a force generated by any attempt to close the associated switch is directed through the pivot axis of the cam plate and generates no component tending to rotate the cam plate. Hence, no force is transmitted to the connecting link or to the cam plate and plunger associated with the switch which is already closed. Opposed springs bias the respective cam plates toward the overtoggle position and urge the interlock to an intermediate position when both switches are open so that either may be closed. A single actuator can be used to selectively block operation of a single switch without transmittal of a force generated by an attempt to close the switch back through the actuator to a manual or motor operator.

12 Claims, 4 Drawing Sheets

INTERLOCK FOR ELECTRICAL SWITCHES

BACKGROUND OF THE INVENTION

1. Field of the Invention

This invention relates to devices which interlock electrical switches to preclude two switches from being in the "on" position simultaneously or to lock out a single switch.

2. Background of Information

There are a number of applications where it is required that the operation of two electrical switches be coordinated such that only one switch can be in the "on" position at a time. One such application is the transfer switch which selectively provides a load with electrical power from either of two different sources, such as for example, a commercial power system and an auxiliary supply which may be a diesel generator, or even another commercial source. Often circuit breakers are used as the switches in such transfer switches although switches without overcurrent protection are also used. It is imperative in such transfer switches that in transferring between independent sources that the switch disconnecting the former source be turned to the "off" position before the switch connecting the new source is turned to the "on" position to preclude interconnecting two sources with a random phase relationship.

Another application for interlocks is in ac motor control circuits such as reversing controls where one switch is used to connect the motor to a source with one phase rotation for forward operation and another switch connects the motor with the opposite phase rotation for reverse operation. Here to, the switches, which may be contactors, motor starters, motor controllers or switches without overcurrent protection can not connect both of the sources to the load at the same time. As used throughout, the term switch will be understood to refer to any of the above mentioned or similar types of switches used in applications where the operation of multiple switches must be coordinated by interlocks. There are some applications where it is desirable to interlock a single such switch.

Some interlocks couple the handles of switches whose operation is to be coordinated. In another type of interlock, used for instance especially when the switches are circuit breakers, has a plunger mounted in the switch housing of each switch which when actuated engages the switch operating mechanism to prevent the switch from closing. In one such interlock, the plungers are coupled to opposite ends of a walking beam so that when one switch is closed it pushes down on its plunger thereby pivoting the walking beam and raising the other plunger to block closing of the other switch. The circuit breaker which is held open lacks sufficient force to override the interlock and force the closed switch open. However, application of a force attempting to close the switch blocked open, places a strain, once the free travel of the handle is taken up, on the mechanism all the way back to the plunger of the switch which is on and the components must be robust enough and constrained sufficiently that they cannot be distorted to the extent that the interlock function is defeated.

In addition, the walking beam type of interlock requires that the plungers on the two switches be aligned in the same plane. This is difficult in some instances because of the arrangement of buses which connect the switch to the line side of the source and to the load may intrude into the alignment plane. Also, it is designed for switches placed side-by-side, but in some installations the switches may not be so aligned.

Another type of interlock utilizing plungers which engage the internal operating mechanisms of the switches is disclosed in U.S. Pat. No. 4,286,242. In this interlock which is designed for use with SPB type circuit breakers, the plunger of a first circuit breaker to be closed engages a lever on a rod to rotate the rod about its axis. Another lever on the other end of the rod engages a push rod which holds the second circuit breaker in the trip-free condition. An identical mechanism engaged when the second circuit breaker is closed, holds the first circuit breaker in the trip-free condition. Thus, two complete mechanisms are required. Again, any attempt to close one circuit breaker while the other is closed, returns the open breaker to the trip-free condition. This interlock requires that the circuit breakers be aligned end-to-end.

There is a need therefore, for an improved interlock for coordinating the operation of two switches.

There is a need for such an improved interlock in which forces generated by an attempt to close a switch which is locked open are not transmitted through the entire mechanism.

There is also a need for such an improved interlock which does not require that the switches be located side-by-side.

There is an additional need for such an improved interlock which provides flexibility for various arrangements of bus bars connected to the switches.

SUMMARY OF THE INVENTION

These and other needs are satisfied by the invention which is directed to an interlock for a pair of electrical switching devices each utilizing a plunger which may when in a first position engage the operating mechanism of the switching device to prevent closing of the contacts of the switching device. An actuator is coupled to each plunger for mutual movement therewith. Each actuator assumes an overtoggle position, however, when the associated plunger is in the first position. The overtoggle position prevents movement of the actuator member by the plunger if an attempt is made to close the contacts of the associated electrical switching device. A connecting member connects the actuators for opposed motion such that when the operating mechanism of one electrical switching device is operated to close the electrical contacts of that device, the plunger of the other electrical switching device is moved to the first position to prevent the operating mechanism of the other electrical switching device from closing the electrical contacts of that device. With that plunger in the first position, the associated actuator is in the overtoggle position, and therefore, forces generated by any attempt to close that switching device are not transmitted back through the connecting member to the one switching device and its plunger and actuator. Among the advantages of this is that the parts do not have to be made as robust as those of earlier interlocks which had to resist distortion which could defeat the interlock function. The invention also has application to a device which prevents closure of a single switch without transmitting a force back through the interlock device when an attempt is made to close the switch.

Preferably, the actuator includes a pivotally mounted cam plate and coupling means coupling the plunger and cam plate for mutual movement. The coupling means comprises a cam slot in the cam plate having an overtoggle section which is tangent to a radius through the pivot axis of the cam plate and a camming section which is slanted with respect to such radii. The coupling means further includes a coupling pin on the plunger engaging the cam slot, and in particular engaging the overtoggle section when the plunger is in the first position. Also, the pivot axis of the cam plate passes transversely through an extension of the longitudinal axis of the plunger along which the plunger moves rectilinearly. Therefore, with the plunger in the first position blocking closing of the contacts of the switching device, the force generated by an attempt to close the switching device is applied through the pivot axis of the cam plate and because the over toggle section of cam slot is perpendicular to this line of force, there is no component tending to rotate the cam plate. As a result, no force is transmitted through the connecting member to the portion of the interlock associated with the other switching device.

Also, the cam plates are biased, preferably by springs, to the over toggle position. The springs are positioned such that the spring force applied to a cam plate increases as the cam plate is rotated from the over toggle position. Thus, when a switching device which has been closed is opened, the spring force applied to the associated cam plate is greater than that on the other cam plate which is in the overtoggle position. The result is that the other cam plate is rotated out of the overtoggle position and an equilibrium is reached with both cam plates in an intermediate position from which either switching device may be closed.

The cam plates are each pivotally mounted on a pivot pin between spaced planar members which have guide slots for the coupling pins extending along radii through the pivot pin and parallel to the longitudinal axis of the associated plunger.

The components of the interlock need not be in the same plane as in the past. Thus, the cam plates can instead be mounted in spaced parallel planes with the connecting member in the form of an elongated member positioned in yet another parallel plane with beams laterally and pivotally connecting ends of the elongated member to the cam plates. This provides flexibility for clearing the bus bars in some installations.

BRIEF DESCRIPTION OF THE DRAWINGS

The invention also has application to an interlock for a single switch where the connecting member is connected to an operating motor or a manual lever which rotates the cam plate to the overtoggle position to block attempts to close the switch without a force being applied back through the connecting member.

A full understanding of the invention can be gained from the following description of the preferred embodiments when read in conjunction with the accompanying drawings in which.

DESCRIPTION OF THE PREFERRED EMBODIMENTS

Figure 1:
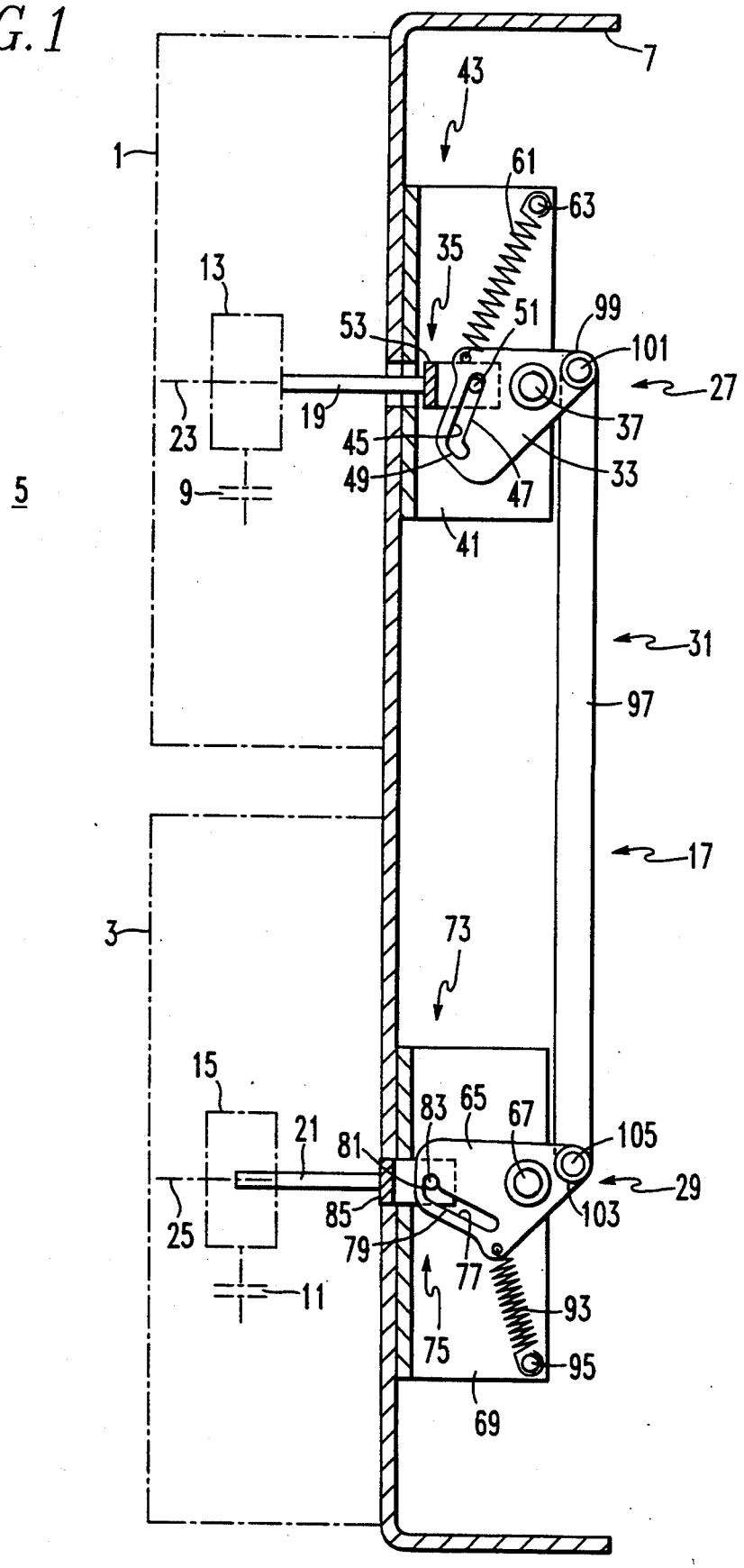
FIG. 1 is a side elevation view of a transfer switch with two circuit breakers interlocked by the invention shown with the upper circuit breaker closed.

The invention will be described as applied to a pair of circuit breakers on molded case switches, such as would be used in a transfer switch. It will become apparent to those skilled in the art; however, that the invention has application to interlocking other types of electrical switching devices such as contactors, motor starters, motor controllers, disconnect switches and other switches without protection functions used in similar or other applications, such as for example, reversing or two speed motor controls, and in fact in any installation where it is desired to interlock two switching devices. It will also become apparent that the invention can be used to interlock a single switch.

Referring to the drawings, two circuit breakers 1 and 3, connected as a transfer switch 5 are mounted one above the other on a base plate 7. The circuit breakers 1 and 3 have electrical contacts 9 and 11 which may be single phase or multi-phase, depending on the electrical systems to which they are connected. The contacts and 11 are opened and closed by an operating mechanism 13 and 15, respectively.

Figure 2:
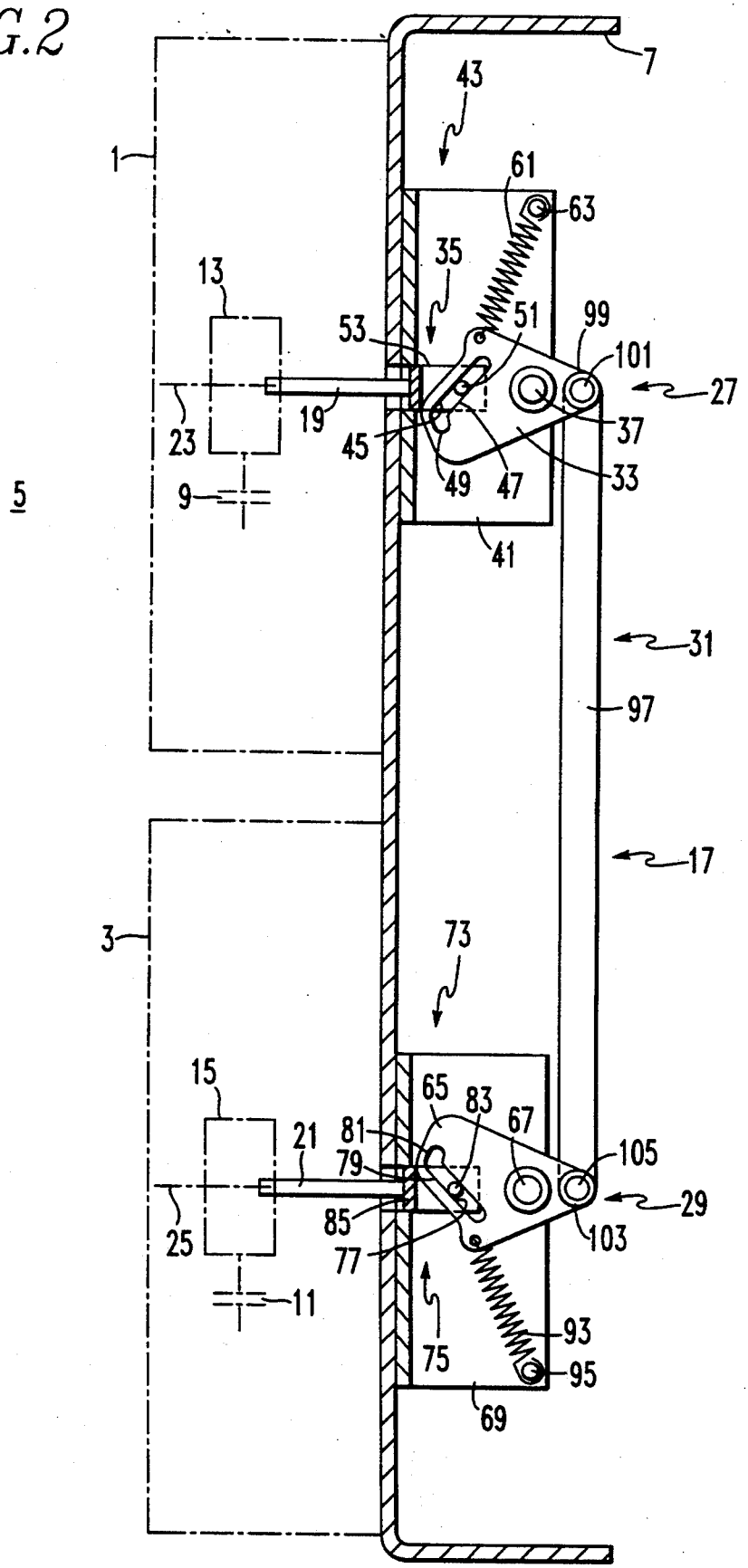
FIG. 2 is a view similar to FIG. 1, but shown with both circuit breakers open.

The circuit breaker 1 may be connected to provide power to a load (not shown) from a normal source such as a commercial power distribution system (also not shown). The circuit breaker 3 alternatively supplies power to the load from an emergency source (not shown). With the sources unsynchronized, it is imperative that only one be connected to the load at any particular time. An interlock assures that a circuit breaker cannot be closed until the other circuit breaker is open. The interlock 17 of the invention includes electrically insulative plungers 19 and 21 which engage the operating mechanisms 13 and 15 of the circuit breakers 1 and 3 in a manner such as that described in U.S. Pat. No. 4,286,242, which is hereby incorporated by reference. The plungers 19 and 21 move rectilinearly along a longitudinal axis 23 and 25. In the first position illustrated by the plunger 21 in FIG. 1, the plunger prevents operation of the operating mechanism 15 to close the contacts 11 of the circuit breaker 3. With both circuit breakers 1 and 3 open, the plungers 19 and 21 assume an intermediate position as shown in FIG. 2. Closure of either of the circuit breakers causes the associated operating mechanism to engage the plunger and extend it away from the above-described first position. As will be seen, the interlock mechanism responds to this movement of the plunger on the circuit breaker which is closed to move the plunger on the other circuit breaker to the first position, which prevents operation of the other circuit breaker.

The interlock 17 further includes an actuator 27 and 29 associated with each of the plungers 19 and 21. These actuators 27 and 29 are interconnected by a connecting member 31 in the form of an elongated member.

The actuator 27 includes a cam plate 33 and a coupling device 35 coupling the cam plate 33 to the plunger 19 for mutual movement. The cam plate 33 is pivotally mounted for rotation about a pivot axis provided by a pivot pin 37 supported in spaced planar members formed by the legs 39 and 41 of a bracket 43 secured to the base plate 7 with the axis formed by the pivot pin 37 transversely extending through a projection of the longitudinal axis 23 of the plunger 19.

The coupling device 35 includes a camming slot 45 which has a camming section 47 and an overtoggle section 49. The overtoggle section 49 of the cam slot 45 is tangent to a radius passing through the pivot axis formed by the pivot pin 37, while the camming section 47 is slanted with respect to radii passing through the pivot axis of the pivot pin 37.

Figure 3:
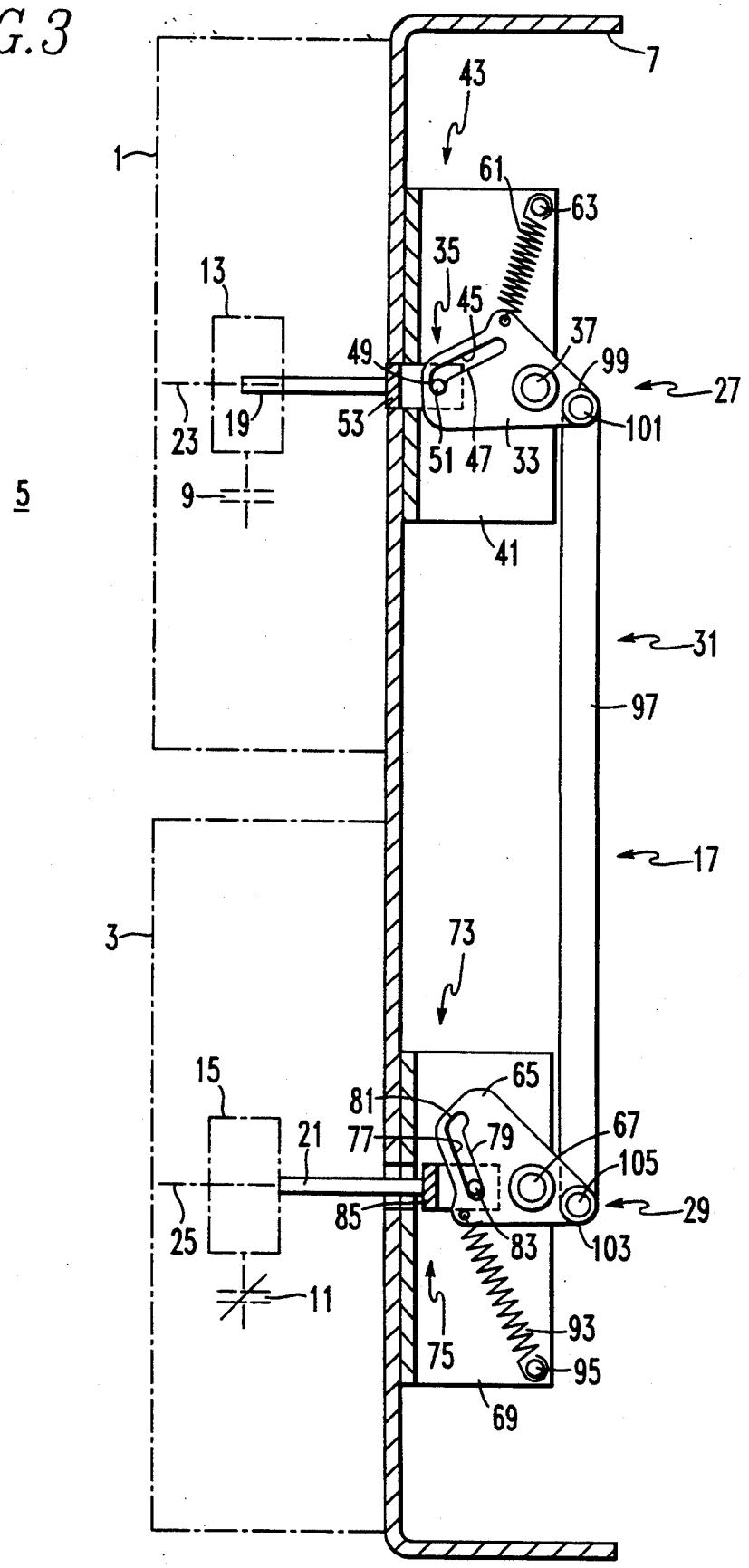
FIG. 3 is a view similar to FIGS. 1 and 2 shown with the lower circuit breaker closed.
Figure 4:
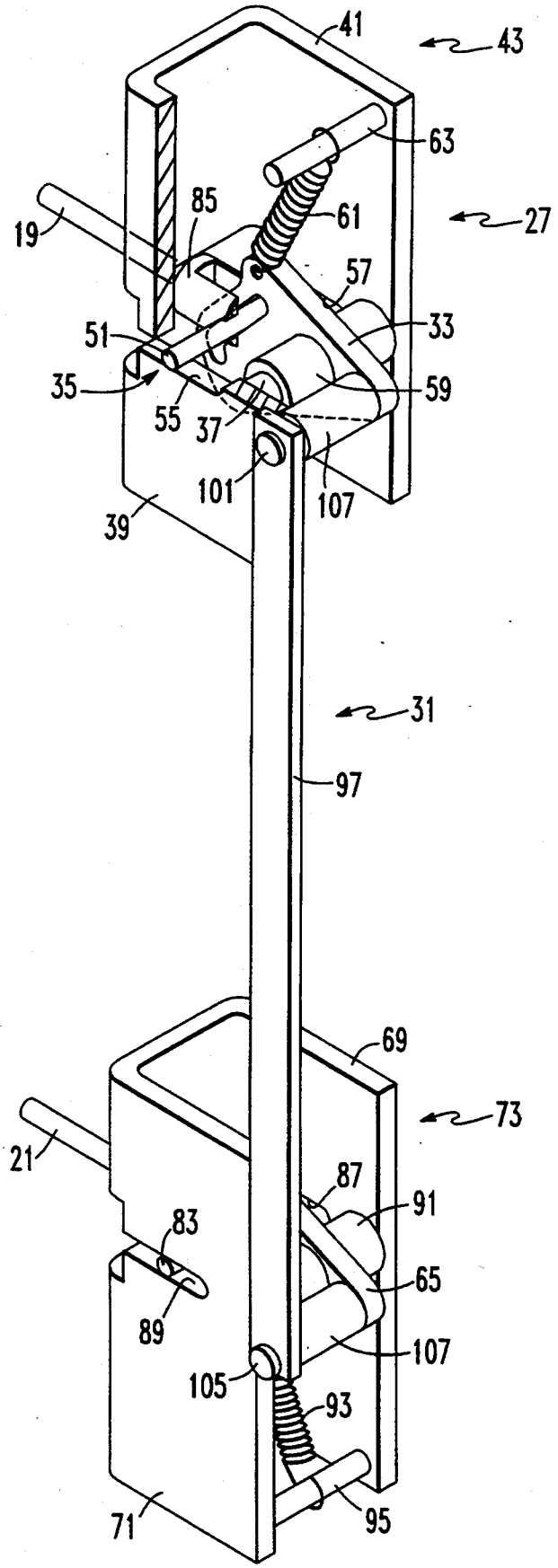
FIG. 4 is an isometric view of an actuator which forms part of the interlock of the invention.

The coupling device 35 further includes a coupling pin 51. Preferably a clevis 53 is provided on the end of the plunger 19. Cam plate 33 is received in the clevis and the coupling pin 51 extends through the legs of the clevis and the cam slot 45. The ends of the coupling pin 51 extend beyond the clevis 53 and engage guide slots 55 and 57 in the legs 39 and 41 of the bracket 43 which are parallel to the longitudinal axis 23 of the plunger. The cam plate 33 is centered on the pivot pin 37 between the legs 39 and 41 by spacers 59. (See FIG. 4). A helical tension spring 61 is stretched between the cam plate 33 and a support pin 63 supported by the legs 39 and 41. The spring 61 biases the cam plate 33 toward an overtoggle position as shown in FIG. 3 in which the coupling pin 51 engages the overtoggle section 49 of the camming slot 45 which raises the plunger 19 to the first position mentioned above in which it blocks operation of the associated operating mechanism 13 and prevents closure of the contacts 9 of the circuit breaker 1.

As mentioned, the coupling device 35 couples the plunger 19 and the cam plate 33 for mutual movement. That is, rotation of the cam plate 33 results in rectilinear motion of the plunger 19. Similarly, movement of the plunger 19 results in rotation of the cam plate 33 through the camming action provided by the engagement of the coupling pin 51 and the camming section 47 of the camming slot 45. However, when the coupling pin 51 engages the overtoggle section 49 of the camming slot 45, a force applied to the plunger 19 by an attempt to operate the operating mechanism 13 to close the contacts 9 is directed along a line of force which passes through the pivot axis of the cam plate 33 formed by the pin 37. Furthermore, since the overtoggle section 49 of the camming slot 45 is tangent to this line of force, there is no component tending to rotate the cam plate 33. Hence, with the plunger 19 in the above-described first position in which the coupling pin 51 engages the overtoggle section 49 of the camming plate, the camming plate 33 cannot be rotated by an attempt to close the contacts 9. On the other hand, when the coupling pin 51 engages the camming section 47 of the camming slot 45, application of a force to the plunger 19 by the operating mechanism 13 rotates the camming plate 33.

The actuator 29 for the plunger 21 on the circuit breaker 3 is a mirror image of the actuator 27. Thus, it also includes a cam plate 65 mounted for pivotal movement about a pivot pin 67 supported by the planar, parallel legs 69 and 71 of the bracket 73 secured to the base plate 7 with the pivot pin 67 extending transversely through an extension of a longitudinal axis 25 of the plunger 21.

The actuator 29 further includes a coupling device 75 comprising the camming slot 77 in the cam plate 65 having a camming section 79 and an overtoggle section 81 configured similarly to the sections 47 and 49 of the camming slot 45 in the cam plate 33. A coupling pin 83 engages the camming slot 77 and extends through the legs of a clevis 85 secured to the end of the plunger 21 and into guide slots 87 and 89 in the legs 69 and 71, respectively of the bracket 73. The cam plate 65 is centered on the pivot pin 67 by spacers 91 and is biased to an overtoggle position, in which the coupling pin 83 engages the camming section 79 of the slot 77, by a tension spring 93 anchored by a pin 95 extending between the legs 69 and 71.

The interlock 17 further includes an elongated connecting member 31 comprising link 97 pivotally connected at one end 99 to the cam plate 33 by pin 101, and at the other end 103 to the cam plate 65 by pin 105. The elongated connecting member 31 transmits rotation of one of the cam plates 33 and 65 to the other. However, as the cam plates 33 and 65 are mirror images of each other, rotation of one cam plate away from the overtoggle position, rotates the other cam plate toward the overtoggle position. Thus, as shown in FIG. 1 when the normal circuit breaker 1 is closed to close its contacts 9, the plunger 19 is moved by the operating mechanism 13 toward the actuator 27. The coupling pin 51 engages the camming section 47 of the camming slot 45 to rotate the cam plate 33 in a clock-wise direction. The elongated connecting member or link 97 rotates the cam plate 65 clock-wise so that the coupling pin 83 slides along the camming section 79 of the camming slot 77 and enters the overtoggle section 81. The spring 93 assures that the pin 83 engages the overtoggle section 81. In this condition, with the contacts 9 of the circuit breaker 1 closed, if an attempt is made to close the contacts 11 of the circuit 3, the operating mechanism 15 of the circuit breaker 3 would apply a force to the plunger 21. However, since the coupling pin 83 is in engagement with the overtoggle section 81 of the camming slot 77, the force applied to the plunger 21 is projected through the pivot pin 67 so that the closure of the contact 11 is blocked. Furthermore, since the camming section 79 of the camming slot 77 is tangent to a radius passing through the pivot pin 67, there is no component of force tending to rotate the cam plate 65. Hence, the attempt to close the circuit breaker 3 applies no force back through the elongated connecting member 31 to the actuator 27.

When the circuit breaker 1 is opened, the spring 61 tends to rotate the cam plate 33 toward the overtoggle position. It will be recalled that the spring 93 is already holding the cam plate 65 in the overtoggle position. However, since the springs are mounted so that they are stretched more as the respective cam plates are rotated away from the overtoggle position, with the cam plate 65 in the overtoggle position and the cam plate 33 rotated away from the overtoggle position, the spring 61 exerts a greater force than the spring 93. Hence, the cam plate 33 is rotated toward the overtoggle position which, through the elongated connecting member 31, rotates the cam plate 65 out of the overtoggle position. The opposing forces exerted by the springs 61 and 93 will reach an equilibrium with the interlock 17 in an intermediate position shown in FIG. 2 in which the coupling pins 51 and 83 engage the approximate middle of the camming sections 47 and 79 of the respective camming slots 45 and 77. In this position, the interlock is ready for either circuit breaker to be closed. If the circuit breaker 3 is closed to close the contacts 11, the operating mechanism 15 will extend the plunger 21 so that the coupling pin 83 rotates the cam plate 65 in a clock-wise direction to the position shown in FIG. 3. This results in rotation of the cam plate 33 by the elongated connecting member 97 to the overtoggle position in which the operating mechanism 13 of the circuit breaker 1 is blocked from closing the contacts 9. Again, any attempt to close the contacts 9 of the circuit breaker 1 is blocked since the line of the force applied to the plunger 19 passes through the pivot pin 37, and the configuration of the overtoggle section 49 of the cam slot 45 results in no component of the force tending to rotate the cam plate 33.

Since no force applied to the contacts of a switch which is blocked open is transmitted to the elongated connecting member, and therefore is not transmitted to the opposite actuator, the components of the interlock 17 do not have to be as robust as in the past to resist forces which could defeat the interlock. Furthermore, the absence of the distorting forces allows the connecting member to be offset from the planes of the cam plates such as by the offset members 107. This allows flexibility to clear the bus bars and stabs (not shown) which are located behind the circuit breakers 1 and 3 for connecting them to the line and load conductors. Thus, the circuit breakers 1 and 3 can be mounted one above the other as shown in FIGS. 1 and 3, and are not limited to side by side placement as was required with some of the prior art interlocks. It will be clear from the above that the interlock of the invention can be used to prevent operation of a single switch. In such a case the connecting link 97 could be connected to a manual handle or a motor operator for instance.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An interlock for a pair of electrical switching devices each having a housing containing electrical contacts and an operating mechanism for opening and closing said electrical contacts, said interlock comprising:

a plunger mounted through each housing and engaging said operating mechanism to prevent said operating mechanism from closing said electrical contacts when said plunger is in a first position;

an actuator associated with each plunger and coupled thereto for mutual movement therewith and having an overtoggle position when the plunger is in said first position which prevents movement of the actuator by the plunger when an attempt is made to operate the operating mechanism to close the electrical contacts and, a connecting member connecting said actuator for opposed motion such that when the operating mechanism of one electrical switching device is operated to close the electrical contacts of said one electrical switching device, the plunger of the other electrical switching device is moved to said first position to prevent the operating mechanism of said other electrical switching device from closing said electrical contacts of said other electrical switching device.

2. The interlock of claim 1 wherein each said actuator comprises a cam plate pivotally mounted adjacent the associated plunger, and coupling means coupling said plunger and said cam plate for said mutual movement and comprising a cam slot in said cam plate having a camming section and an overtoggle section, and a coupling pin on said plunger engaging said cam slot, said coupling pin engaging said overtoggle section of said cam slot with said plunger in said first position and said actuator in said overtoggle position.

3. The interlock of claim 2 wherein said plunger is mounted for rectilinear motion along a longitudinal axis, said cam plate is pivotally mounted for rotation about a pivot axis passing transversely through an extension of said longitudinal axis, said overtoggle section of said cam slot is generally tangent to a radius passing through said pivot axis, and said camming section of said cam slot is on a slanted bias with respect to radii passing through said pivot axis.

4. The interlock of claim 3 wherein each actuator further includes biasing means biasing said cam plate toward said overtoggle position.

5. The interlock of claim 4 wherein each biasing means comprises a spring generating a spring force which increases with displacement and wherein each spring is mounted such that displacement increases with rotation of the cam plate away from said overtoggle position, whereby when the operating mechanisms of both electrical switching devices opens the electrical contacts, each cam plate is rotated to an intermediate position with said pin engaging said camming section of said cam slot.

6. The interlock of claim 5 wherein said cam plates rotate in spaced parallel planes and said connecting member comprises an elongated member and means laterally pivotally connecting ends of said elongated member to said cam plates for translation in a plane parallel to said spaced parallel planes.

7. The interlock of claim 3 wherein each said actuator includes a mounting bracket having spaced planar members, a pivot pin extending between said planar members forming said pivot axis for said cam plate which is positioned between said planar members, said planar members each having a guide slot extending along a radius through said pivot pin, said coupling pin engaging said guide slots as well as said cam slot.

8. The interlock of claim 2 wherein said cam plates rotate in spaced parallel planes and said connecting member comprises an elongated member and means laterally pivotally connecting ends of said elongated member to said cam plates for translation in a plane parallel to said spaced parallel planes.

9. An interlock for an electrical switching device having a housing containing electrical contacts and an operating mechanism for opening and closing said electrical contacts, said interlock comprising:

a plunger mounted through said housing and engaging said operating mechanism to prevent said operating mechanism from closing said electrical contacts when said plunger is in a first position;

an actuator comprising a cam plate pivotally mounted adjacent the said plunger, and coupling means coupling said plunger and said cam plate for mutual movement and comprising a cam slot in said cam plate having a camming section and an overtoggle section, and a coupling pin on said plunger engaging said cam slot, said coupling pin engaging said overtoggle section of said cam slot with said plunger in said first position and said actuator in an overtoggle position; and a connecting member connected to rotate said actuator into said overtoggle position in which closure of said electrical contacts is blocked and to rotate said actuator out of said overtoggle position to a position in which said coupling pin engages said camming section of said cam slot and in which said electrical contacts can be closed by said operating mechanism.

10. The interlock of claim 9 wherein said plunger is mounted for rectilinear motion along a longitudinal axis, said cam plate is pivotally mounted for rotation about a pivot axis passing transversely through an extension of said longitudinal axis, said overtoggle section of said cam slot is generally tangent to a radius passing through said pivot axis, and said camming section of said cam slot is slanted with respect to radii passing through said pivot axis.

11. The interlock of claim 10 wherein said actuator further includes biasing means biasing said cam plate toward said overtoggle position.

12. The interlock of claim 10 wherein said actuator includes a mounting bracket having spaced planar members, a pivot pin extending between said planar members forming said pivot axis for said cam plate which is positioned between said planar members, said planar members each having a guide slot extending along a radius through said pivot pin, said coupling pin engaging said guide slots as well as said cam slot.

* * * * *